US008755540B1

(12) United States Patent
Lunc et al.

(10) Patent No.: US 8,755,540 B1
(45) Date of Patent: Jun. 17, 2014

(54) SONIC MOTION OPERATED DEVICES

(75) Inventors: Bruce D Lunc, River Forest, IL (US); Michael D Starrick, Maywood, IL (US); Guruge Weerauppulige, Forest Park, IL (US)

(73) Assignee: Lund and Company Invention L.L.C., River Forest, IL (US)

( * ) Notice: Subject to any disclaimer, the term of this patent is extended or adjusted under 35 U.S.C. 154(b) by 716 days.

(21) Appl. No.: 12/985,846

(22) Filed: Jan. 6, 2011

Related U.S. Application Data

(63) Continuation-in-part of application No. 12/497,794, filed on Jul. 6, 2009, now Pat. No. 8,498,433.

(51) Int. Cl.
*H04R 25/00* (2006.01)

(52) U.S. Cl.
USPC ..... 381/162; 381/178; 310/81; 310/328; 310/322; 446/3; 463/65

(58) Field of Classification Search
USPC ..... 381/71.2, 162, 164, 178, 191; 310/81, 310/328, 323.01, 330, 323.17, 323.03, 310/323.06, 322; 446/3, 65; 463/65, 69; 181/141, 143, 161–163; 185/38, 39; 367/180
See application file for complete search history.

(56) References Cited

U.S. PATENT DOCUMENTS

| | | | | |
|---|---|---|---|---|
| 853,730 | A | 5/1907 | Pearson | |
| 2,392,547 | A | 1/1946 | Plebanek | |
| 2,400,261 | A | 5/1946 | Plebanek | |
| 2,811,809 | A | 11/1957 | Di Franco | |
| 3,196,580 | A | 7/1965 | Rakestraw | |
| 4,882,500 | A * | 11/1989 | Iijima | 310/323.06 |
| 5,679,047 | A | 10/1997 | Engel | |
| 7,436,101 | B1 * | 10/2008 | Magnussen et al. | 310/323.16 |
| 2006/0125336 | A1 * | 6/2006 | Treat | 310/81 |
| 2009/0107772 | A1 | 4/2009 | Lund | |
| 2009/0311941 | A1 | 12/2009 | Bickerton | |

* cited by examiner

*Primary Examiner* — Vivian Chin
*Assistant Examiner* — Friedrich W Fahnert

(57) ABSTRACT

The instant development relates to utilizing the sonic motion generated by a speaker to move objects in various directions in response to the variation in the frequency and amplitude of the sonic vibrations. This can be used to move objects in a linear and/or rotating manner.

6 Claims, 12 Drawing Sheets

SONIC MOTION OPERATED DEVICES

This application is a continuation-in-part application of Lund et al application entitled "Sonic Motion Apparatus" filed on Jul. 6, 2009 having Ser. No. 12/497,794.

FIELD OF THE INVENTION

The present invention relates to various types of devices including toys that use sonic motion to move them in various ways to provide joy and delight to children. Children are enthralled and enchanted to have a play environment where characters move autonomously such as a miniature circus. The current invention consists of a wide variety of mechanisms that move characters in a different way using vibrations generated from a vibration source such as a speaker or other vibration generating member.

BACKGROUND OF THE INVENTION

Movable toys have long been the mainstay of young children that normally require motion and thus require relatively complex mechanisms to provide the requisite motions. The employment of sonic motion is a simple and readily available way of providing motion to characters, swings and other play types of equipment that can provide hours of entertainment to children.

DESCRIPTION OF THE INVENTION

In this application we have taken the broad concepts set forth in the aforementioned Sonic Motion Apparatus application and utilized sonic motion to provide an additional array of toys that will amuse and enchant children of all ages. The motions generated by the vibration generation member can be used to simulate cooking in a play kitchen such as boiling water and food cooking in a shallow vessel using vibrations generated from a vibration generation source. Also, some vibration members can be used to move in various ways character swings, bumper cars etc. In essence a microprocessor is programmed to generate vibration through a vibration generation member such as a speaker diaphragm having a varying or steady frequency or amplitude to vary the speed and/or movement of an object placed in direct or indirect contact with a vibration generation member or the like that is energized by sound waves. This can be accomplished by placing an object on a vibration generation member surface that directly moves the object placed thereon, by placing the object to be moved on a support plate connected to the vibration generation member, or by utilizing the vibrations to move rods and/or gears to operate various appendages of a character, bumper cars, swings etc.

Through the use of directional members located on the bottom of the item being moved or on a member adjacent to the item to be moved by direct or indirect contact with the vibration generation member the item will respond to the sound waves to move in a rotary and/or linear direction.

A programmed microprocessor or a radio are two ways that the sonic motion can be generated. An object to be moved in response to sound waves can, by way of example, in addition to a vibration generation member such as a speaker diaphragm or plate connected thereto be placed on the speaker of a cell phone or at the outlet of a microphone or musical instrument.

Essentially, in accordance with the invention, an object can be operated by the sonic motion created where sound waves are emitted. The particular movement of the object in question can, in one instance, be controlled by directional members located on the bottom of the object being moved and subjected to the vibration impacted against the directionally oriented vibration reaction members or conversely the directional members can be located on the vibration imparting element to act upon the object in question.

Furthermore the sonic motion can be employed to rotate a member that can in turn through a gear arrangement operate a swing, move a teeter totter, drive bumper cars etc.

DESCRIPTION OF THE DRAWINGS

FIG. 3 *a* is a side view of the teeter-totter of FIG. 3 shown in a tilted position.

FIG. 4 A shows the ball rotation segment constructed from clear components to create the illusion of an object floating in mid-air above the elephant's trunk;

DESCRIPTION OF THE DRAWINGS

Figure 1:
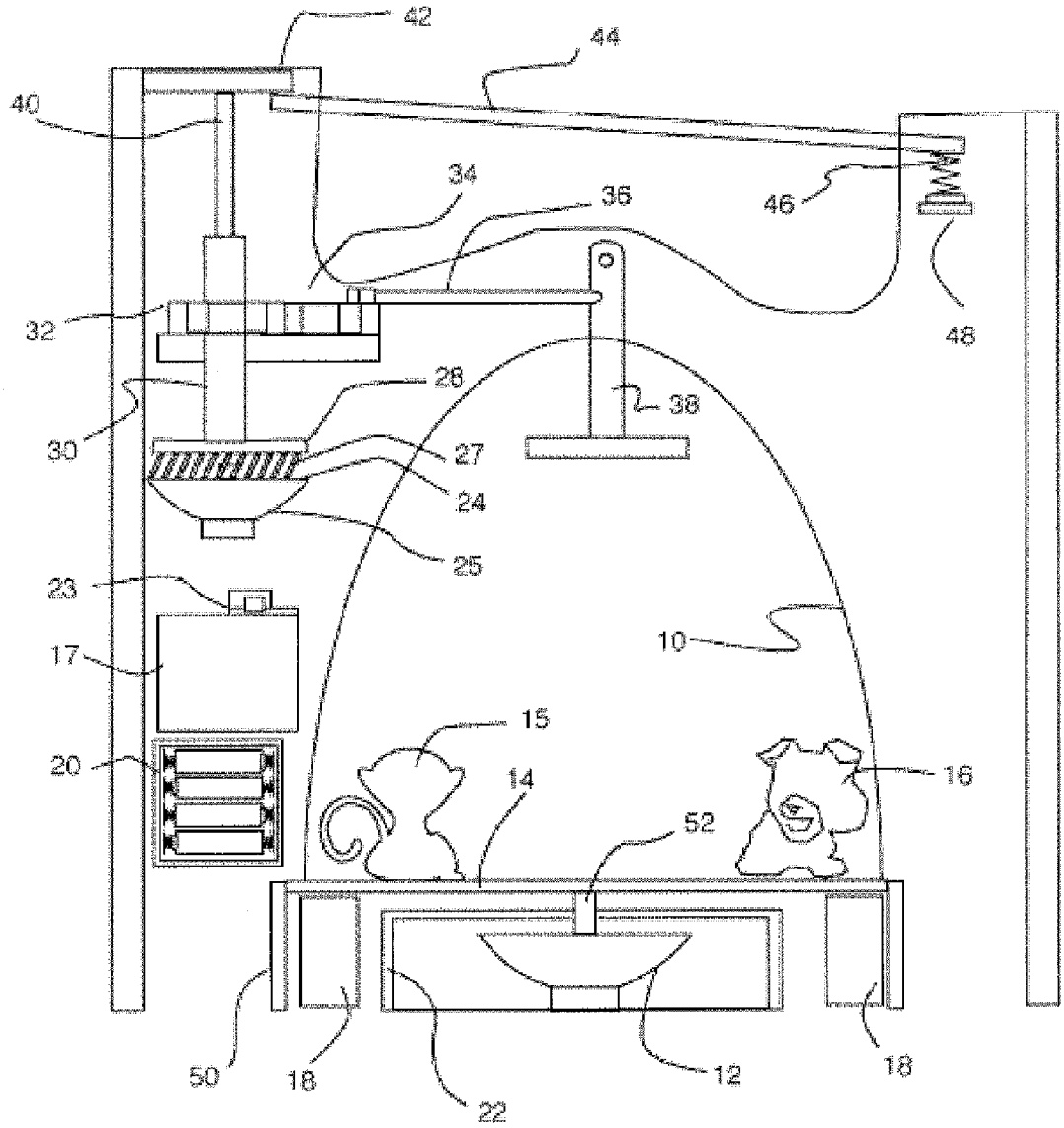
FIG. 1 is a cross-sectional view of a play set including a vibration surface to move objects placed thereon and also including a second vibration generating mechanism to operate a swing and tight rope located within the play set.

In FIG. 1 we see a cross-sectional view of a play-set 10. The play-set 10 includes a vibration generating member herein indicated as the speaker 12. The speaker 12 activates the vibration surface 14 through the action of the vibration transfer rod 52. Located on the vibration surface 14 and moved by the motion caused by the vibration surface 14 are the animal characters 15, 16. The vibration surface 14 is loosely supported by the standoffs 18. The speaker 12 is enclosed in a housing 22 and the locating ring 50 limits the side to side movement of the vibration surface 14 and could limit the travel of the characters 15,16 placed on the vibration surface 14.

Figure 2:
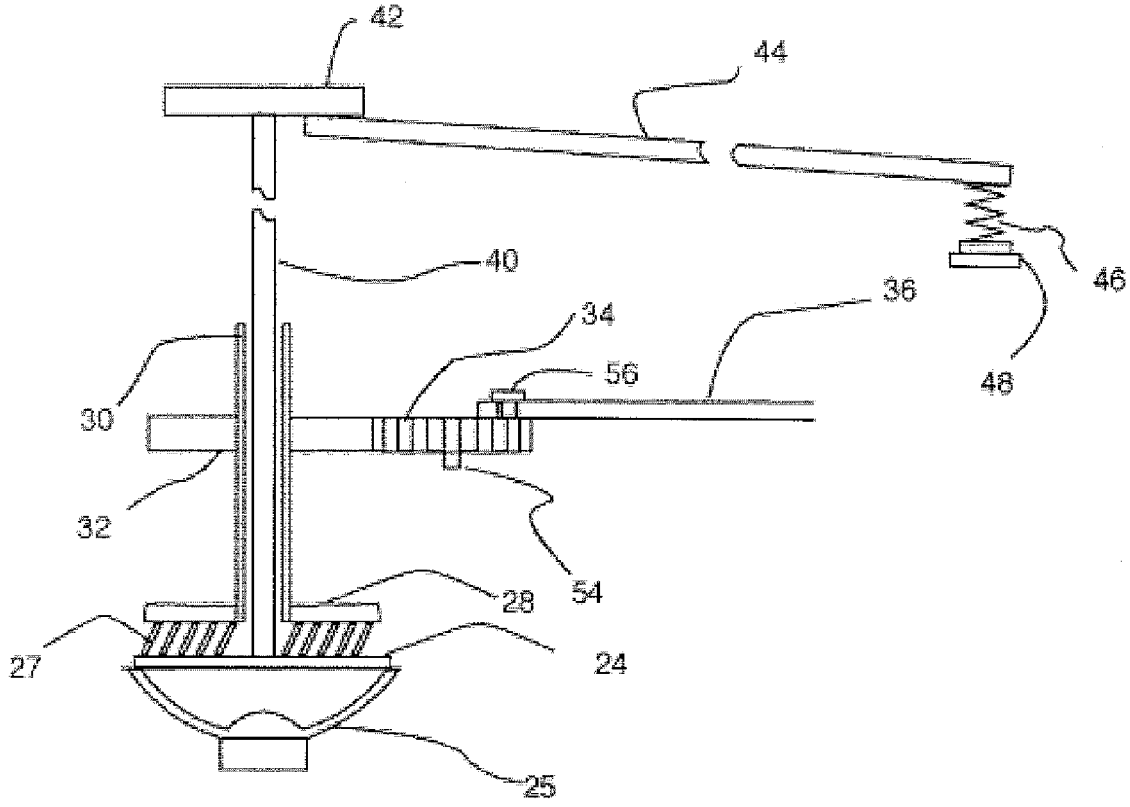
FIG. 2 is a partial enlarged section of the secondary vibration mechanism for operating the swing set and tight rope disclosed in FIG. 1.

Also attached to the play set 10 and forming a part thereof is a second vibration member 24 shown on a speaker 25. As shown in FIG. 1 and more specifically in FIG. 2 there is illustrated a centrally located vibration transfer rod 40 that transfers vibration from the vibration member 24 to a tight rope platform 42 which will be discussed later.

Returning now to the speaker 25 it will be seen that its vibration surface 24 will act on rotationally oriented vibration reaction members 27 secured to plate 28 connected to gear tube 30 to rotate gear 32. The rotation of gear 32 rotates crank gear 34 about its axle 54 (see FIG. 2). Connected to the gear 34 is swing link pivot pin 56 (see FIG. 2) to which swing link 36 is loosely connected to. The swing link 36 is connected to swing 38 upon which a child may place a character that swings back and forth by means of swing link 36.

Briefly, the swing link 36 freely rotates around swing link pivot pin 56 to transfer the crank action of crank gear 34. Returning now to the tight rope platform 42 it is noted that abutting same is a tight rope 44. The free end of tight rope 44 is loosely attached to play set 10 by spring 46 which is supported by platform 48.

The electrical impulses for vibration generating members shown here as speakers 12 and 25 are produced by a microprocessor control 17. The microprocessor control 17 is powered by batteries 20 through a power switch 23. The microprocessor is programmed to operate the vibration generating members in the desired sequence to perform the desired sequence of movements. A child interaction momentary switch (not shown) is closed to signal microprocessor 17 to initiate or move to the next portion of the preprogrammed sequence.

Figures 3, 3A:
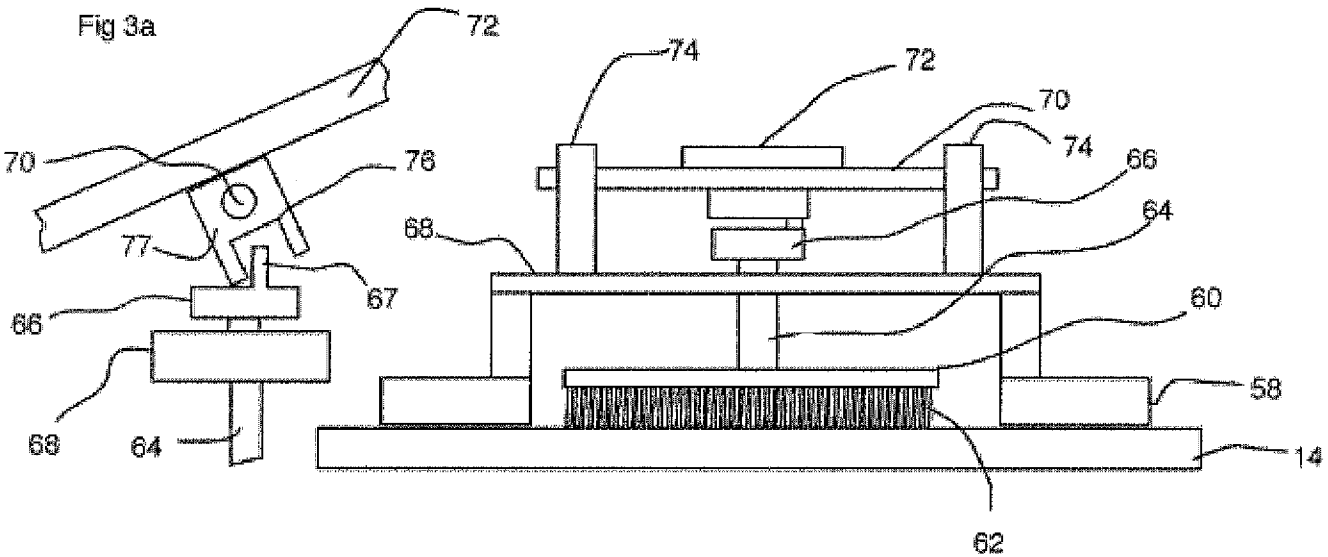
FIG. 3 is a cross-section view illustrating a teeter-totter being operated by a sonic motion device.

FIG. 3 illustrates a schematic view of a teeter totter 58 which sets upon vibrating surface 14. The rotating vibration disk 60 has attached to its surface rotationally oriented vibration reaction members 62 which react to the vibrations caused by the vibrating surface 14. The rotating vibration disk 60 is attached to shaft 64 which is in turn attached to crank 66 that includes the upstanding crank pin 67 extending into slot 76 of the teeter totter crank pin follower 77. As the crank 66 is rotated the crank pin 67 moves the teeter totter plate 72 up and down about the teeter totter pivot 70. The teeter totter pivot 70 is supported by pivot supports 74 which in turn are supported by support plate 68 that also in turn holds shaft 64 centrally located while allowing for rotation of shaft 64.

Figure 4:
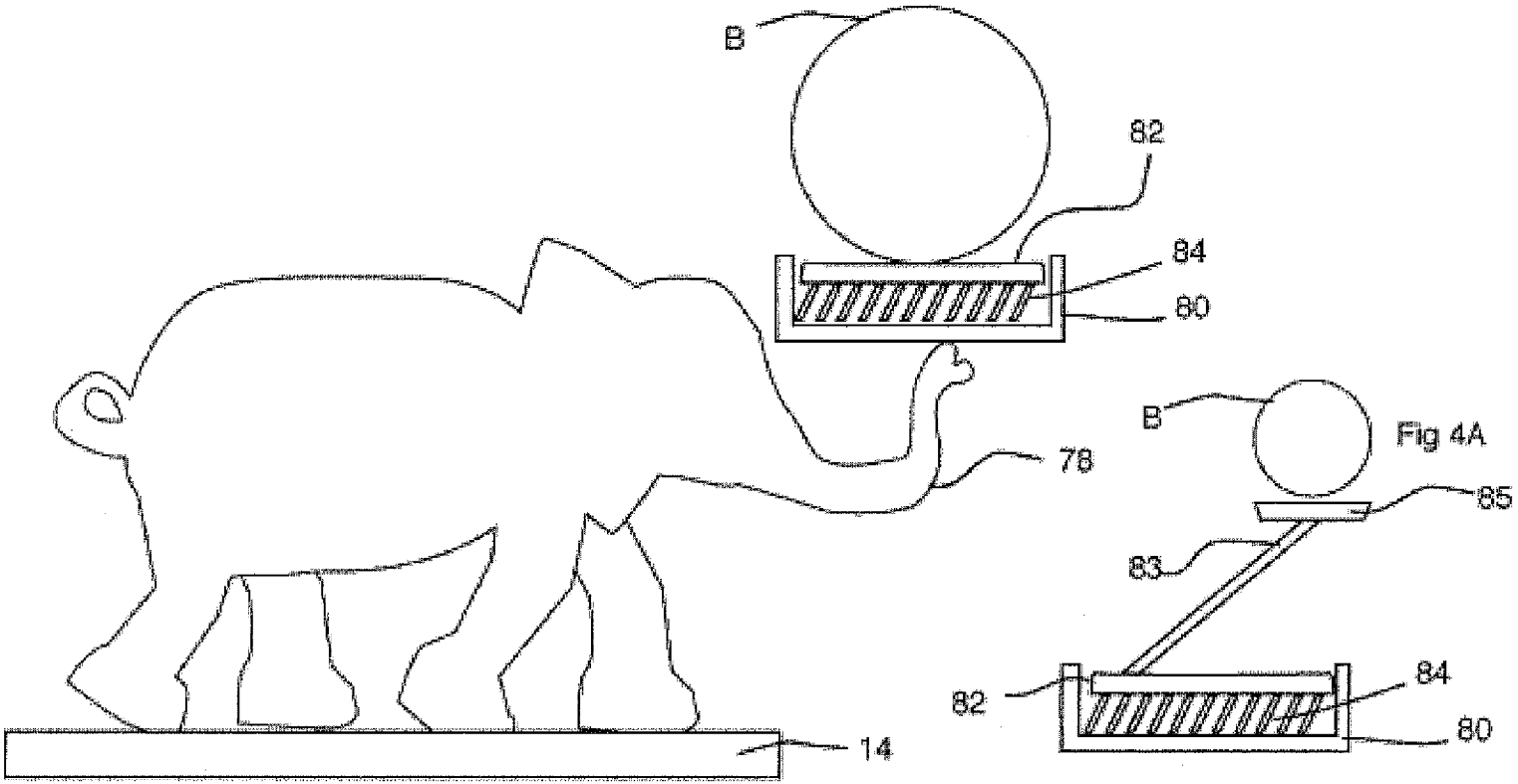
FIG. 4 illustrates an elephant moved by sonic motion to translate its motion to rotate a ball located on a rotating plate.

In FIG. 4 we see a figure 78 here represented as an elephant which stands on vibration surface 14. Vibrations are transferred through figure 78 to tray 80. Placed in tray 80 is a rotating sphere plate 82 to the bottom of which is secured rotationally oriented vibration reaction members 84 that impose a rotational movement to the ball B to delight the child.

Turning now to FIG. 4 A there is shown a floating rotating plate 85 secured to the rotating sphere plate 82 which along with rod 83 are made of clear components to create the illusion of a ball B floating in mid air above the trunk of the elephant 78.

Figure 5:
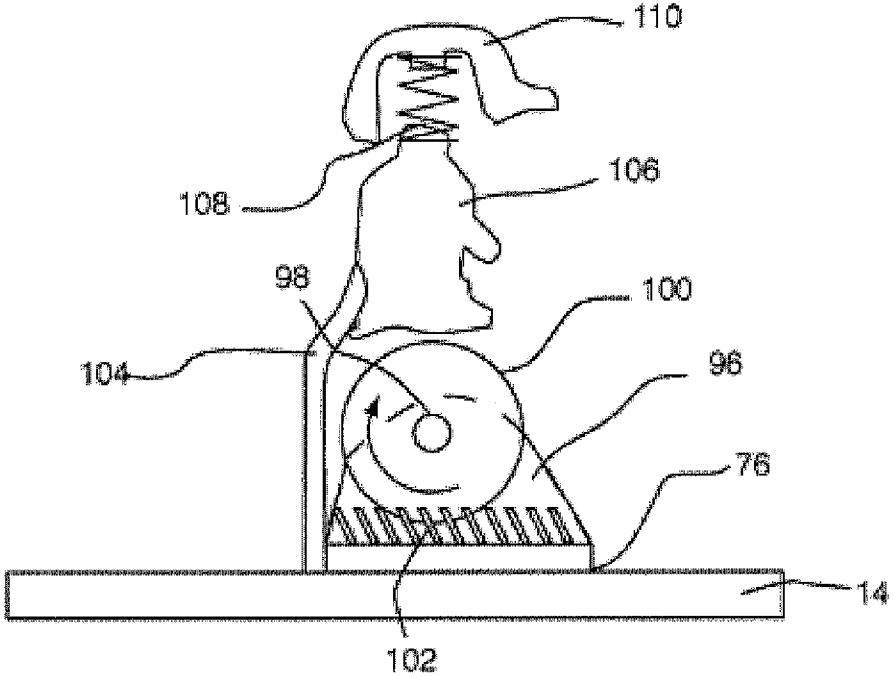
FIG. 5 shows a character in close proximity to a barrel rotated by a sonic motion apparatus.

In FIG. 5 there is shown a simulation of a small character 106 balancing on a barrel 100. The barrel 100 has two axially located pins 98 protruding from either end which are located in barrel pivot supports 96. Located beneath the barrel 100 and in contact herewith are directionally oriented vibration reaction members 102 secured to base 76 that act upon the bottom of barrel 100 and cause the barrel 100 to rotate from the vibrations of vibration surface 14. A support member 104 holds the character 106 in close proximity to the upper surface of the barrel 100.

Located in the hollow head 110 of the character 106 is spring 108 that allows for the bobble movement of the hollow head 110.

Figure 6:
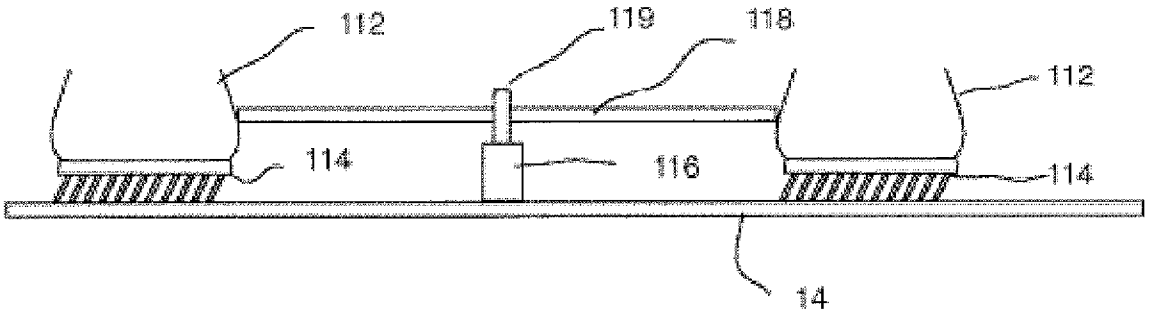
FIG. 6 discloses a cross-sectional view of a pair of bumper cars that are rotated by a vibration generating member transmitting sonic motion to oriented directional vibration reaction members connected to the bottom of the bumper cars.

FIG. 6 shows a cross-sectional view of a pair of bumper cars 112 that are secured to connecting rod 118. The rod 118 has a centrally located hole that loosely fits over the smaller diameter portion 119 of the central pivot 116. Secured to the bottom of the bumper cars 112 are rotationally oriented vibration reaction members 114 which when placed on the vibrating surface 14 move the bumper cars around the central pivot 116.

Figure 7:
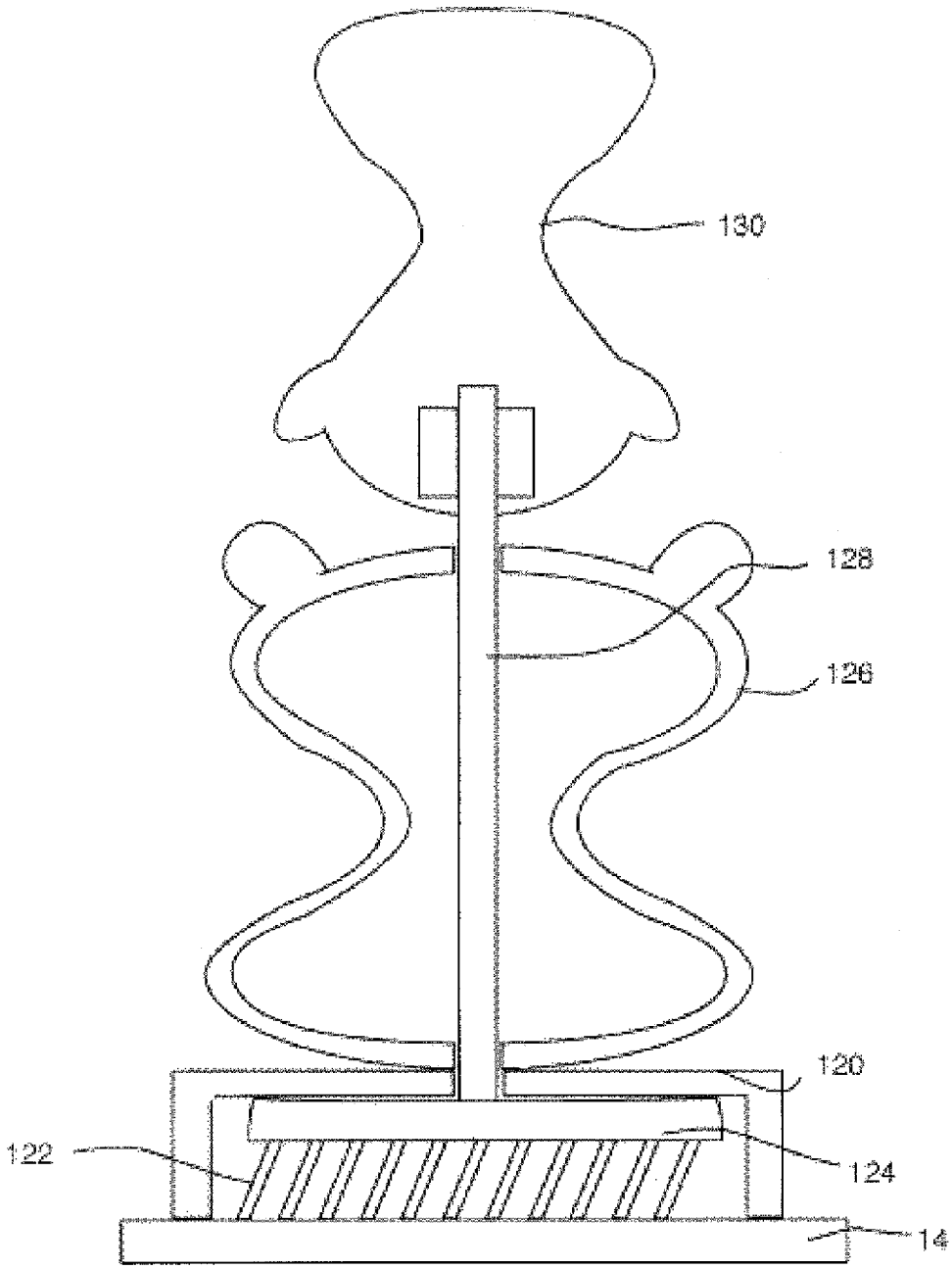
FIG. 7 illustrates an-inverted character located on the head of a base character which inverted character is connected to a rod that is connected to a plate that is rotated by the rotationally oriented vibration reaction members secured to the bottom of the rod plate.

Another toy operated by sonic motion is illustrated in FIG. 7. In FIG. 7 we see a simulation of a character 130 spinning inverted on the head of a base character 126. The base character 126 is attached to the base 120 which sets upon vibrating surface 14. Located within the base 120 is the vibrating disk 124 which has attached to its underside rotationally oriented vibration reaction members 122. Attached to the rotating disk 124 is the shaft 128 that transfers the rotary action of disk 124 to FIG. 130.

Figure 8:
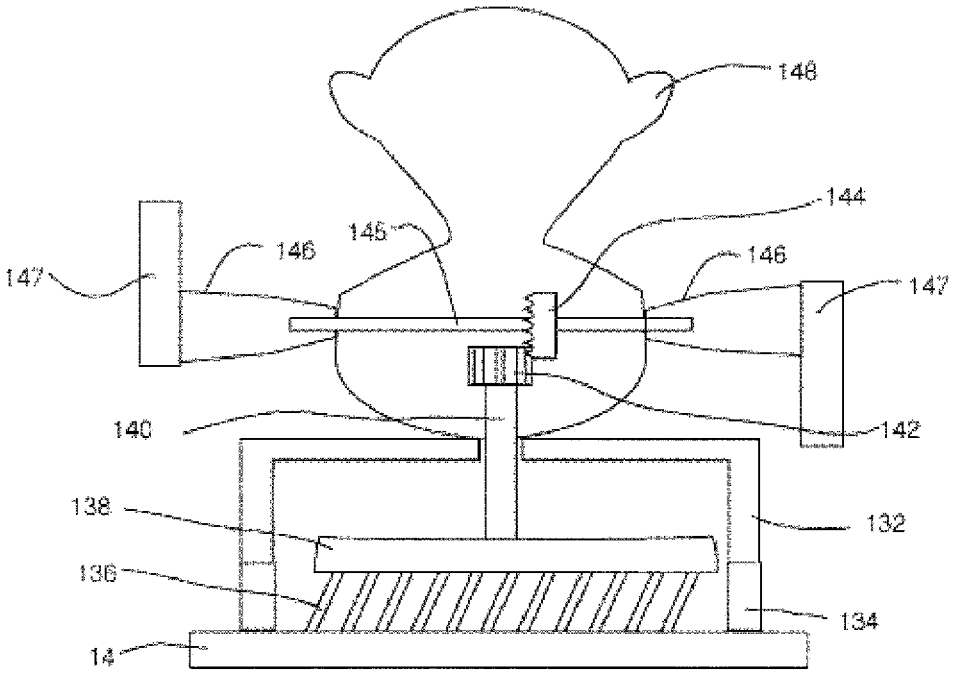
FIG. 8 shows the arms of a figure moved through a gear mechanism that is operated by a plate-mounted rod, which plate has rotationally oriented vibration reaction members connected to its base that responds to sonic vibrations that rotate the rod connected to the arms of the figure having rings attached thereto to simulate spinning rings.

In FIG. 8 there is shown a sonically operated toy that uses sonic motion to rotate arms 146 that have rings 147 attached thereto to simulate spinning rings. There is included a base 132 which has foam isolaters 134 attached to the bottom thereof which isolates the vibration surface 14 from the base 132. Located within the base 132 is the rotating disk 138 which has rotationally oriented vibration reaction members 136 attached to the surface adjacent to vibration surface 14. Attached to the rotating disk 138 is shaft 140. At the other end of shaft 140 is a pinion gear 142. As the rotating disk 138 rotates pinion gear 142 the pinion gear 142 moves crown gear 144 to rotate the attached shaft 145. Shaft 145 is attached to arms 146 that have rings 147 attached to their ends to simulate spinning rings. Character 148 is the central support housing for the actions of the crown gear shaft assembly 144.

Figure 9:
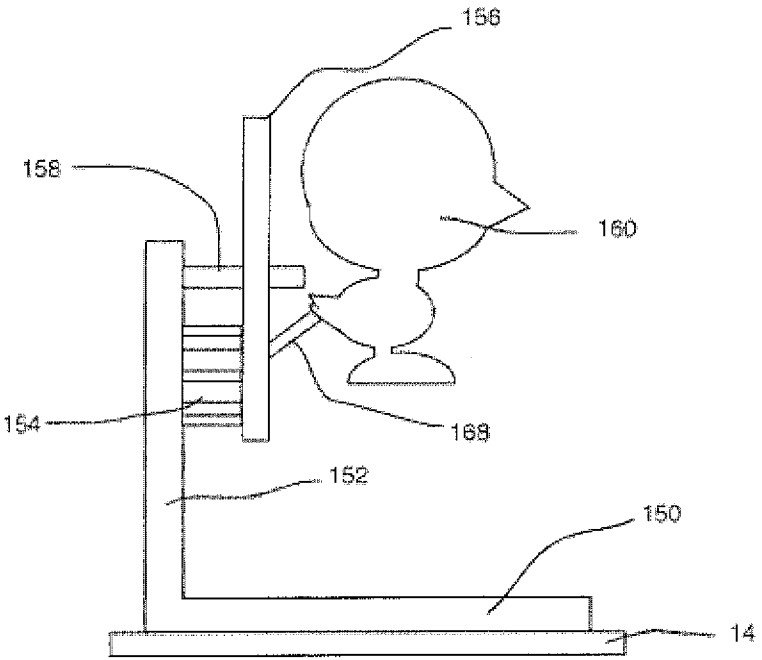
FIG. 9 discloses a vibration device used to rotate an attached character in a vertically rotational direction.

Turning now to FIG. 9 there is shown a base 150 that is placed on vibration surface 14. The vibrations from base 150 are transferred up through upright member 152. Connected to the upright member 152 are rotationally oriented vibration reaction members 154 along with the character pivot 158. Freely rotating on the character pivot 158 is the disk 156 and attached thereto is the character 160 by connector 168. When vibrations from vibration surface 14 are transferred through base 150 and upright member 152 the disk 156 is rotated in response to the vibration reaction members 154 to rotate attached character 160 in a vertical rotational direction.

Figure 10:
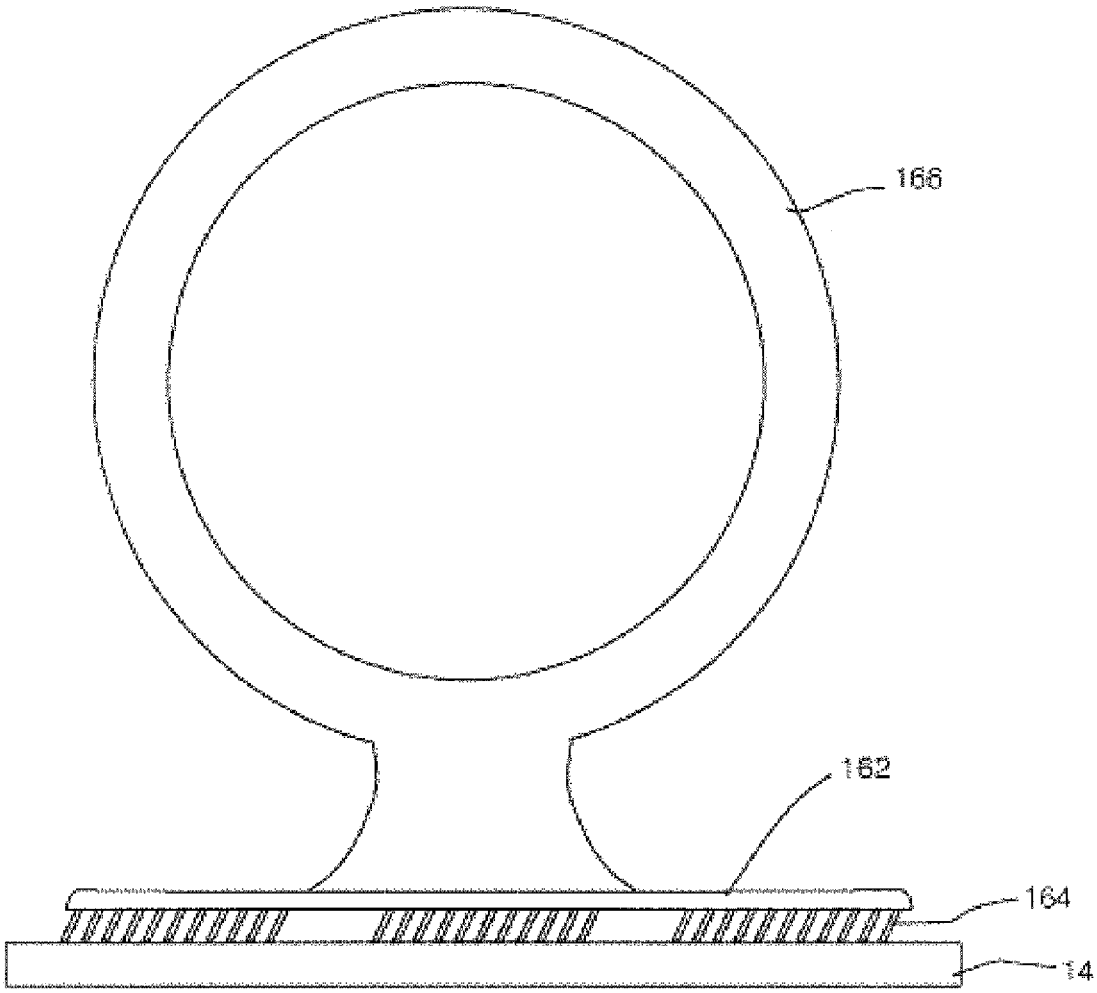
FIG. 10 shows a generally ring-like member placed upon a disc that has rotationally oriented vibration reaction members secured to its bottom that rotates the ring-like member when it is placed on a sonically regulated vibration surface.

FIG. 10 discloses a rotating ring like structure 166 placed on a disk 162 which has rotationally oriented vibration reaction members 164 that move the ring like structure 166 in a horizontally circular pattern when the ring like structure 166 and disk 162 are placed upon vibration surface 14.

Figure 11:
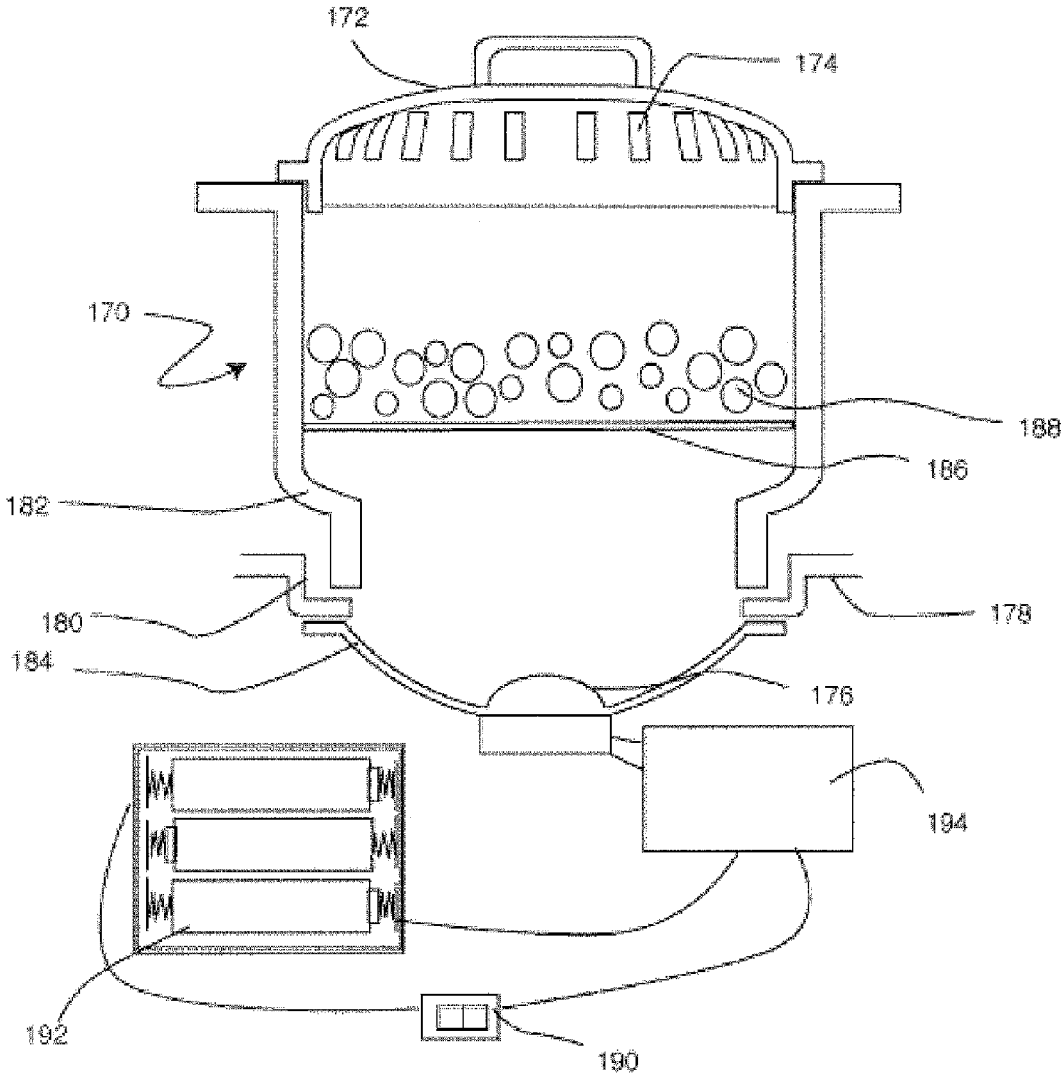
FIG. 11 illustrates a cooking vessel containing balls on a vibration member which when activated visually simulates boiling water.

In FIG. 11 we see a closed vessel 170 with a permanently sealed lid 172 which has pressure relieving slots 174. The closed vessel 170 has a vibration generating member shown here as a speaker 176 located below the play cooking surface 178 which has a recess 180 to accept the bottom oriented locating ring 182 of closed vessel 170. The vibration generating member 176 has a speaker surface 184 which transfers the vibration from vibration generating member 176 to the vibration transfer membrane 186. Various sized balls 188 are resting on vibration transfer membrane 186 and react to the vibration impact from vibration generating member 176. The various sized balls 188 interact with each other and the vibration membrane 186 and the resulting visual simulates boiling water.

It is noted that there is switch 190 that controls voltage from battery back 192 to microprocessor control electronics 194 to power vibration generating member 176. Microprocessor control electronics 194 can produce both vibrations and sound to mimic the sound of boiling water as well as vibrations to act upon the vibration transfer membrane 186 to impact the visual of boiling water.

Figure 12:
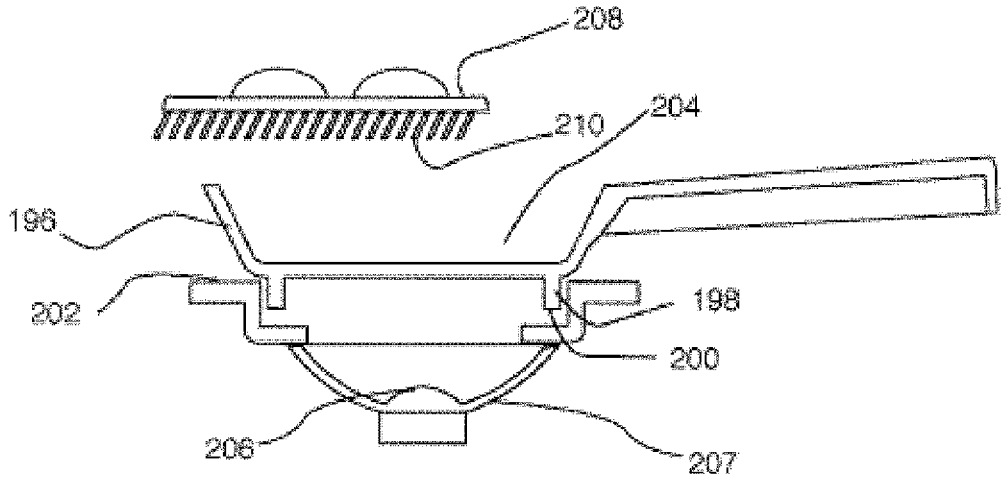
FIG. 12 shows a shallow vessel containing play food resting on the bottom thereof which when activated simulates cooking of the play food.

In FIG. 12 we see a cross-sectional view of a shallow open vessel similar to a frying pan 196 with a bottom oriented locating ring 198. The bottom located oriented locating ring 198 rests in the recess 200 of the play cooking surface 202. The bottom surface 204 of the open vessel 196 vibrates from input from the vibration generating member shown here as speaker 206. Also in FIG. 12 is shown play food shown here as eggs Molded into the underside of play food 208 are directional members 210. The rotationally oriented directional members 210 move in a circular motion when in contact with the bottom surface 204 and when bottom surface 204 is vibrating from the input from the vibration generating members shown here as speaker 206 and vibrating surface 207. Other type of food could be used, and other directions of movement could be achieved by the orientation of the directional member 210. It remains to note that while microprocessor control electronics, switches and battery pack are shown in FIGS. 1, and 11 to operate the vibrating surfaces they are also employed in the other embodiments illustrated.

It is intended to cover by the appended claims all improvements and modifications that come within the true spirit and scope of the invention.

The invention claimed is:

1. A sonically operated assembly consisting of a vibration source assembly having a vibrating surface, power for operating said vibrating source, a power operated programmer for controlling the frequency and amplitude of the vibrating surface, support means for holding at least one object to be activated by said vibrating surface, said object and support means includes a disk to which said directionally oriented members are secured and a ball located on said disk whereby upon activation of said vibrating surface the ball is rotated.

2. A sonically operated assembly as set forth in claim 1 in which the vibrating disk supporting the directionally oriented members receives its vibrations from a character to which it is attached which in turn receives its vibrations from a vibrating surface supporting said character.

3. A sonically operated assembly as set forth in claim 2 in which there is located between the ball and disk a transparent support to give the illusion of the ball hanging free.

4. A sonically operated assembly consisting of a vibration source assembly having a vibrating surface, power for operating said vibrating surface, a power operated programmer for controlling the frequency and amplitude of a first vibrating surface, a receptacle including a second vibrating surface located within a dosed container and contains a series of balls located thereon whereby when the first vibrating surface is activated the second vibrating surface moves the balls to simulate boiling water.

5. A sonically operated assembly in accordance with claim 4 in which the second vibrating surface is the bottom of a frying pan and located thereon is a food product supported on a disk having rotationally oriented fibers in contact with the frying pan bottom and when the first vibrating surface is activated the food product in said pan will rotate with respect thereto.

6. A sonically operated assembly consisting of a vibration source assembly having a vibrating surface, power for operating said vibrating source, a power operated programmer for controlling the frequency and amplitude of the vibrating surface, support means for holding at least one object to be activated by said vibrating surface, said object and support means includes a disk to which is secured rotationally oriented vibration member, a rod secured to said disk and extending normal thereto, a housing surrounding said disk and supported by said vibrating surface, a first figure supported on said housing, a second figure secured to said rod and disposed adjacent said first figure whereby upon activation of said vibrating surface the second figure is rotated relative to said first figure.

* * * * *

UNITED STATES PATENT AND TRADEMARK OFFICE

CERTIFICATE OF CORRECTION

PATENT NO. : 8,755,540 B1
APPLICATION NO. : 12/985846
DATED : June 17, 2014
INVENTOR(S) : Lund et al.

It is certified that error appears in the above-identified patent and that said Letters Patent is hereby corrected as shown below:

On the title page correct the following:

Item (12) United States Patent
Correct "Lunc et al." to -- Lund et al. --; and

Item (75) Inventors:
Correct "Bruce D. Lunc, River Forest, IL (US);" to -- Bruce D. Lund, River Forest, IL (US); --

Signed and Sealed this
Fifth Day of April, 2016

Michelle K. Lee

Michelle K. Lee
*Director of the United States Patent and Trademark Office*